US005207982A

United States Patent [19]

Nazmy et al.

[11] Patent Number: 5,207,982

[45] Date of Patent: May 4, 1993

[54] HIGH TEMPERATURE ALLOY FOR MACHINE COMPONENTS BASED ON DOPED TIAL

[75] Inventors: Mohamed Nazmy, Fislsibach; Markus Staubli, Dottikon, both of Switzerland

[73] Assignee: Asea Brown Boveri Ltd., Baden, Switzerland

[21] Appl. No.: 695,406

[22] Filed: May 3, 1991

[30] Foreign Application Priority Data

May 4, 1990 [CH] Switzerland ..... 1523/90
May 4, 1990 [CH] Switzerland ..... 1524/90
May 11, 1990 [CH] Switzerland ..... 1616/90

[51] Int. Cl.[5] ..... C22C 14/00; C21D 1/00

[52] U.S. Cl. ..... 420/418; 148/407; 148/421; 420/421

[58] Field of Search ..... 420/418, 421; 148/407, 148/421

[56] References Cited

U.S. PATENT DOCUMENTS

| | | | |
|---|---|---|---|
| 3,203,794 | 8/1965 | Jaffee et al. | 75/175.5 |
| 4,294,615 | 10/1981 | Blackburn et al. | 420/420 |
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,849,168 | 7/1989 | Nishiyama et al. | 420/417 |
| 4,857,268 | 8/1989 | Huang et al. | 148/2 |
| 4,923,534 | 5/1990 | Huang et al. | 148/407 |
| 5,045,406 | 9/1991 | Huang | 148/421 |
| 5,080,860 | 1/1992 | Huang | 420/418 |
| 5,082,506 | 1/1992 | Huang | 420/419 |

FOREIGN PATENT DOCUMENTS

| | | |
|---|---|---|
| 0275391 | 7/1988 | European Pat. Off. . |
| 0349734 | 1/1990 | European Pat. Off. . |
| 0363598 | 4/1990 | European Pat. Off. . |
| 0405134 | 1/1991 | European Pat. Off. . |
| 3111152 | 5/1988 | Japan . |
| 1255632 | 10/1989 | Japan . |

OTHER PUBLICATIONS

Whang et al. in ASM Symp. "Enhanced Properties in Structural Metals . . . ", Materials Week 1986, Oct., Orlando Fla., pp. 1-7.

Wunderlich et al Z. Metallkoe, 81 (Nov. 1990) p. 802.

N. S. Stoloff, "Ordered alloys—physical metallurgy and structural applications", *International Metals Reviews*, vol. 29, No. 3 (1984), pp. 123-135.

G. Sauthoff, "Intermetallische Phasen", *Magazin Neue Werkstoffe*, (1989), pp. 15-19.

Y. W. Kim, "Intermetallic Alloys Based on Gamma Titanium Aluminide", *JOM*, (Jul. 1989), pp. 24-30.

*Primary Examiner*—Upendra Roy

*Attorney, Agent, or Firm*—Burns, Doane, Swecker & Mathis

[57] ABSTRACT

The high temperature alloy is intended for machine components subjected to high mechanical and thermal stress. It is essentially based on doped TiAl and has the following composition:

$$Ti_xEl_yMe_zAl_{1-(x+y+z)},$$

in which

El = B, Ge or Si and Me = Co, Cr, Ge, Hf, Mn, Mo, Nb, Pd, Ta, V, W, Y, and/or Zr and:

| | | | |
|---|---|---|---|
| 0.46 | $\leqq x$ | $\leqq 0.54$, | |
| 0.001 | $\leqq y$ | $\leqq 0.015$ | for El = Ge and Me = Cr, Hf, Mn, Mo, Nb, Ta, V and/or W, |
| 0.001 | $\leqq y$ | $\leqq 0.015$ | for El = Si and Me = Hf, Mn, Mo, Ta, V and/or W, |
| 0 | $\leqq y$ | $\leqq 0.01$ | for El = B and Me = Co, Ge, Pd, Y and/or Zr, |
| 0 | $\leqq y$ | $\leqq 0.02$ | for El = Ge and Me = Co, Ge, Pd, Y and/or Zr, |
| 0.0001 | $\leqq y$ | $\leqq 0.01$ | for El = B and Me = Cr, Mn, Nb and/or W, |
| 0.01 | $\leqq z$ | $\leqq 0.04$ | if Me = an individual element, |
| 0.01 | $\leqq z$ | $\leqq 0.08$ | if Me = two or more individual elements and |
| 0.46 | $\leqq (x + y + z)$ | $\leqq 0.54$. | |

3 Claims, 11 Drawing Sheets

HIGH TEMPERATURE ALLOY FOR MACHINE COMPONENTS BASED ON DOPED TIAL

BACKGROUND OF THE INVENTION

1. Field of the Invention

High temperature alloys for thermal equipment based on intermetallic compounds which are suitable for ordered solidification and supplement the conventional nickel-based superalloys.

The invention relates to the further development and improvement of the alloys based on an intermetallic compound of the titanium aluminide TiAl type with further additives which increase the strength, the toughness and the ductility.

In the narrower sense, the invention relates to a high temperature alloy for machine components based on doped TiAl.

2. Discussion of Background

Intermetallic compounds of titanium with aluminum have some valuable properties which make them appear attractive as structural materials in the medium and higher temperature range. These include, inter alia, their density, which is low compared with superalloys and reaches only about half the value for Ni superalloys. However, their brittleness stands in the way of their industrial applicability in the present form. The former can be improved by additives, in which case higher strength values are also achieved. Possible intermetallic compounds, some of which have already been introduced, which are known as structural materials are, inter alia, nickel aluminides, nickel silicides and titanium aluminides.

Attempts have already been made to improve the properties of pure TiAl by slight modifications of the Ti/Al atomic ratio and by alloying with other elements. Further elements proposed were, for example, alternatively Cr, B, V, Si, Ta as well as (Ni+Si) and (Ni+Si+B), and also Mn, W, Mo, Nb, Hf. The intention was, on the one hand, to reduce the brittleness, that is to say to increase the ductility and toughness of the material, and, on the other hand, to achieve as high a strength as possible in the temperature range of interest between room temperature and operating temperature. An additional aim was a sufficiently high resistance to oxidation. These aims were, however, only partially achieved.

The high temperature strength of the known aluminides in the meantime still leaves something to be desired. Corresponding to the comparatively low melting point of these materials, the strength, in particular the creep resistance in the upper temperature range, is inadequate, as can also be seen from relevant publications.

U.S. Pat. No. 3,203,794 discloses a TiAl high temperature alloy containing 37% by weight of Al, 1% by weight of Zr and remainder Ti. The comparatively small addition of Zr causes this alloy to have properties comparable to those of pure TiAl.

EP-A1-0,365,598 discloses a high temperature alloy based on TiAl with Si and Nb additives, whereas in EP-A1-0 405 134 a high temperature alloy based on TiAl with Si and Cr additives is proposed.

The following documents are also cited in respect of the prior art:

N.S. Stoloff, "Ordered alloys-physical metallurgy and structural applications", International metals review, Vol. 29, No. 3, 1984, pp. 123–135.

G. Sauthoff, "Intermetallische Phasen"("Intermetallic Phases"), Werkstoffe zwischen Metall und Keramik, Magazin neue Werkstoffe 1/89, p. 15–19.

Young-Won Kim, "Intermetallic Alloys based on Gamma Titanium Aluminide", JOM, Jul. 1989.

U.S. Pat. No. 4,842,819

U.S. Pat. No. 4,842,819

U.S. Pat. No. 4,842,820

U.S. Pat. No. 4,857,268

U.S. Pat. No. 4,836,983

EP-A-0,275,391

The properties of the known modified intermetallic compounds in general do not yet meet the technical demands for the production of usable workpieces therefrom. This applies in particular with regard to high-temperature strength and toughness (ductility). There is therefore a need for further development and improvement of such materials.

SUMMARY OF THE INVENTION

An object on which the invention, as defined is to provide a lightweight alloy which has adequate resistance to oxidation and corrosion at high temperatures and at the same time a high high-temperature strength and sufficient toughness in the temperature range of 500 to 1,000° C., which alloy is very suitable for ordered solidification and essentially consists of a high melting point intermetallic compound.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
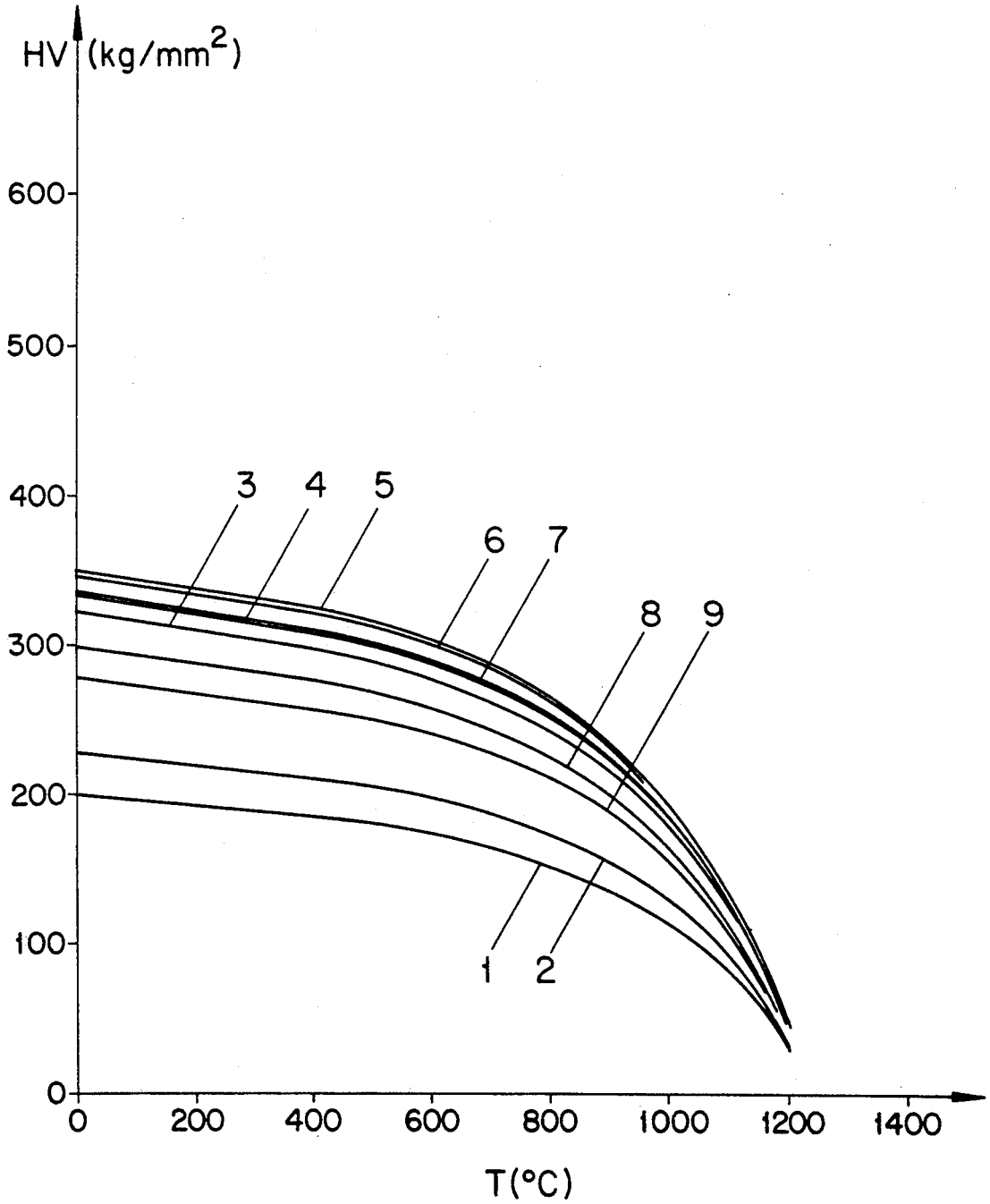
FIGS. 1–4 show graphs of the Vickers hardness HV as a function of the temperature for alloys 3–9, 14–20, 21–27 and 33–38 based on the intermetallic compound titanium aluminide, and also for comparison alloys 1 and 2.

Referring now to the drawings, wherein like reference numerals designate identical or corresponding parts throughout the several views, FIG. 1 is a graph of the Vickers hardness HV (kg/mm$^2$) as a function of the temperature T (° C.) for alloys 3–9 based on the intermetallic compound titanium aluminide. In order to obtain an overview of the influence of the alloy elements, the Vickers hardnesses for the pure titanium aluminides 1 and 2 containing 50 at. % Al and containing 48 at. % Al have also been plotted. The alloys have the following composition:

Alloy 1: 50 at. % Ti, remainder Al

Alloy 2: 52 at. % Ti, remainder Al

Alloy 3: 48.5 at. % Ti, 3 at. % W, 0.5 at. % Ge, 48 at. % Al

Alloy 4: 50.5 at. % Ti, 3 at. % W, 0.5 at. % Ge, 46 at. % Al

Alloy 5: 48.5 at. % Ti, 3 at. % W, 0.5 at. % Si, 48 at. % Al

Alloy 6: 47.5 at. % Ti, 4 at. % W, 0.5 at. % Si, 48 at. % Al

Alloy 7: 48.5 at. % Ti, 3 at. % Cr, 0.5 at. % Ge, 48 at. % Al

Alloy 8: 48.5 at. % Ti, 3 at. % Ta, 0.5 at. % Ge, 48 at. % Al

Alloy 9: 48.5 at. % Ti, 3 at. % Ta, 0.5 at. % Si, 48 at. % Al

The curves all show a similar characteristic shape. Up to a temperature of about 500° C. a fall of on average 10% must be expected. At 700° C. the HV hardness is still about 80% and at 850° C. still about 70% of the value at room temperature.

Figure 2:
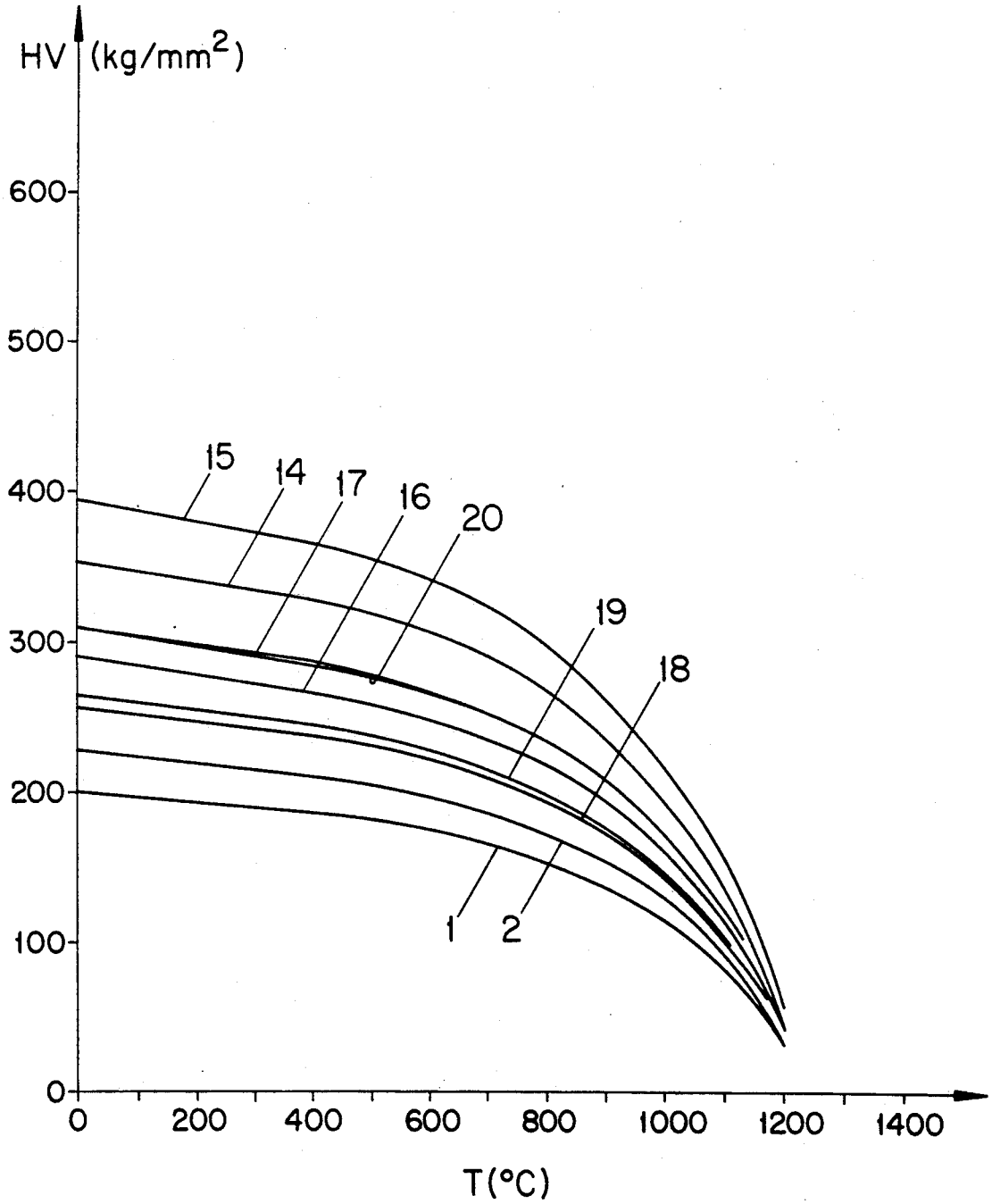

FIG. 2 is a graph of the Vickers hardness HV (kg/mm$^2$) as a function of the temperature T (° C.) for alloys 14–20 based on the intermetallic compound titanium aluminide and for comparison alloys 1 and 2.

Alloy 1: 50 at. % Ti, remainder Al

Alloy 2: 52 at. % Ti, remainder Al

Alloy 14: 50 at. % Ti, 2 at. % Y, 48 at. % Al

Alloy 15: 49 at. % Ti, 3 at. % Y, 48 at. % Al

Alloy 16: 49 at. % Ti, 3 at. % Ge, 48 at. % Al

Alloy 17: 49 at. % Ti, 3 at. % Pd, 48 at. % Al

Alloy 18: 50 at. % Ti, 2 at. % Co, 48 at. % Al

Alloy 19: 51 at. % Ti, 1 at. % Zr, 48 at. % Al

Alloy 20: 49 at. % Ti, 3 at. % Zr, 48 at. % Al

The curves all show a similar characteristic shape. Up to a temperature of about 500° C. a fall of on average 10% must be expected. At 700° C. the HV hardness is still about 80% and at 850° C. still about 70% of the value at room temperature.

Figure 3:
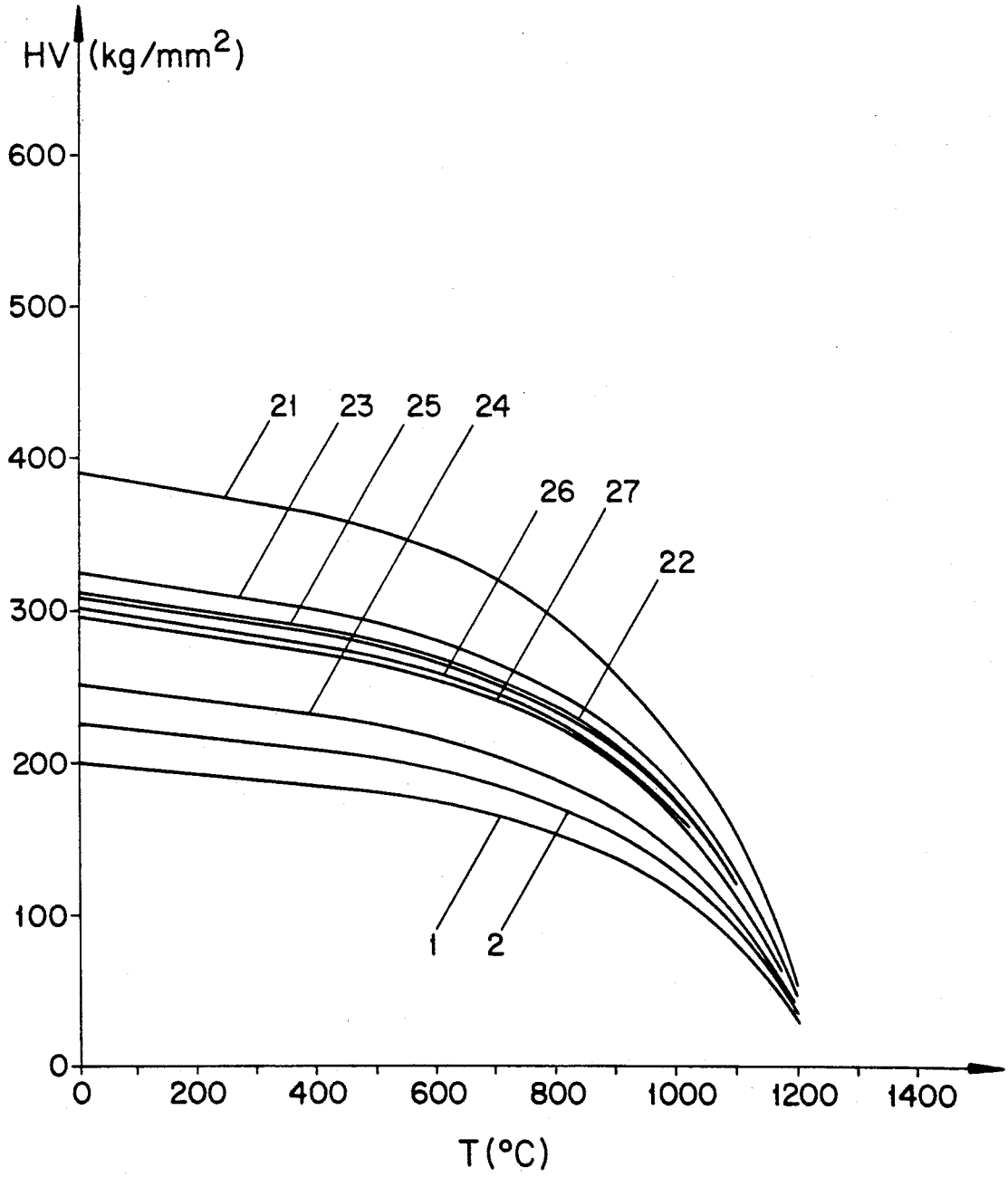

FIG. 3 relates to the graph of the Vickers hardness HV as a function of the temperature T for alloys 21–27 based on the intermetallic compound titanium aluminide and also for the comparison alloys 1 and 2.

Alloy 21: 48.5 at. % Ti, 3 at. % Y, 0.5 at. % B, 48 at. % Al

Alloy 22: 47 at. % Ti, 3 at. % Zr, 2 at. % Ge, 48 at. % Al

Alloy 23: 48.5 at. % Ti, 3 at. % Y, 0.5 at. % Ge, 48 at. % Al

Alloy 24: 50.5 at. % Ti, 1 at. % Zr, 0.5 at. % Ge, 48 at. % Al

Alloy 25: 48.5 at % Ti, 3 at. % Zr, 0.5 at. % Ge, 48 at. % Al

Alloy 26: 48.5 at. % Ti, 3 at. % Pd, 0.5 at. % Ge, 48 at. % Al

Alloy 27: 48.5 at. % Ti, 3 at. % Co, 0.5 at. % Ge, 48 at. % Al

What has been stated under FIG. 2 applies.

Figure 4:
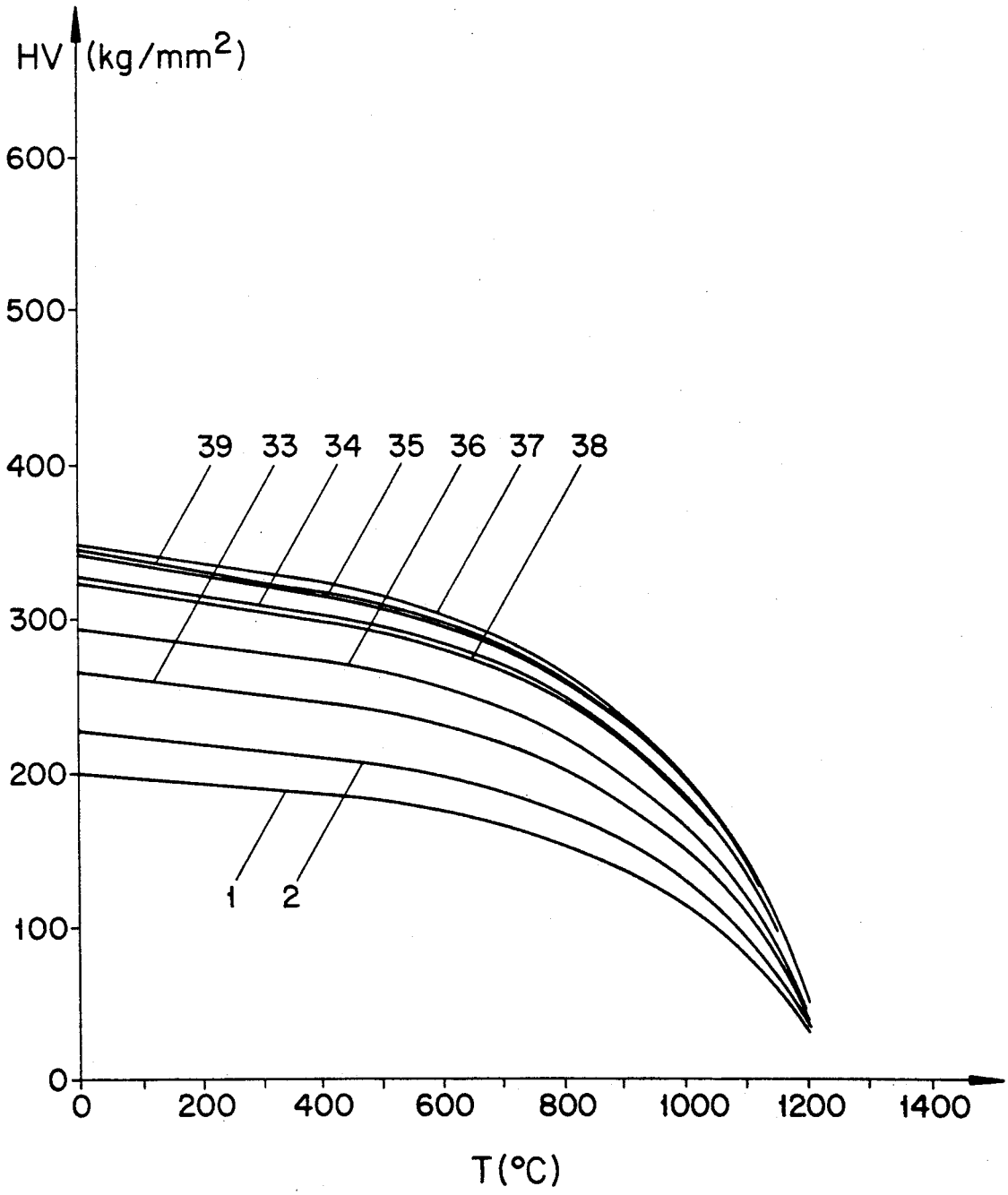

FIG. 4 is a graph of the Vickers hardness HV (kg/mm$^2$) as a function of the temperature T (° C.) for alloys 33–39 based on the intermetallic compound titanium aluminide and for the comparison alloys 1 and 2.

Alloy 1: 50 at. % Ti, remainder Al

Alloy 2: 52 at. % Ti, remainder Al

Alloy 33: 50.5 at. % Ti, 1 at. % W,, 0.5 at. % B, 48 at. % Al.

Alloy 34: 48.5 at. % Ti, 3 at. % W, 0.5 at. % B, 48 at. % Al.

Alloy 35: 48 at. % Ti, 3 at. % W, 1 at. % B, 48 at. % Al.

Alloy 36: 49.5 at. % Ti, 2 at. % Mn, 0.5 at. % B, 48 at. % Al.

Alloy 37: 48.5 at. % Ti, 3 at. % Cr, 0.5 at. % B, 48.5 at. % Al.

Alloy 38: 47.5 at. % Ti, 2 at. % Mn, 2 at. % Nb, 0.5 at. % B, 48 at. % Al.

Alloy 39: 48.5 at. % Ti, 2 at. % Cr, 1 at. % Mn, 0.5 at. % B, 48 at. % Al.

The curves all show a similar characteristic shape. Up to a temperature of about 500° C. a fall of on average 10% must be expected. At 700° C. the HV hardness is still about 80% and at 850° C. still about 70% of the value at room temperature.

Figure 5:
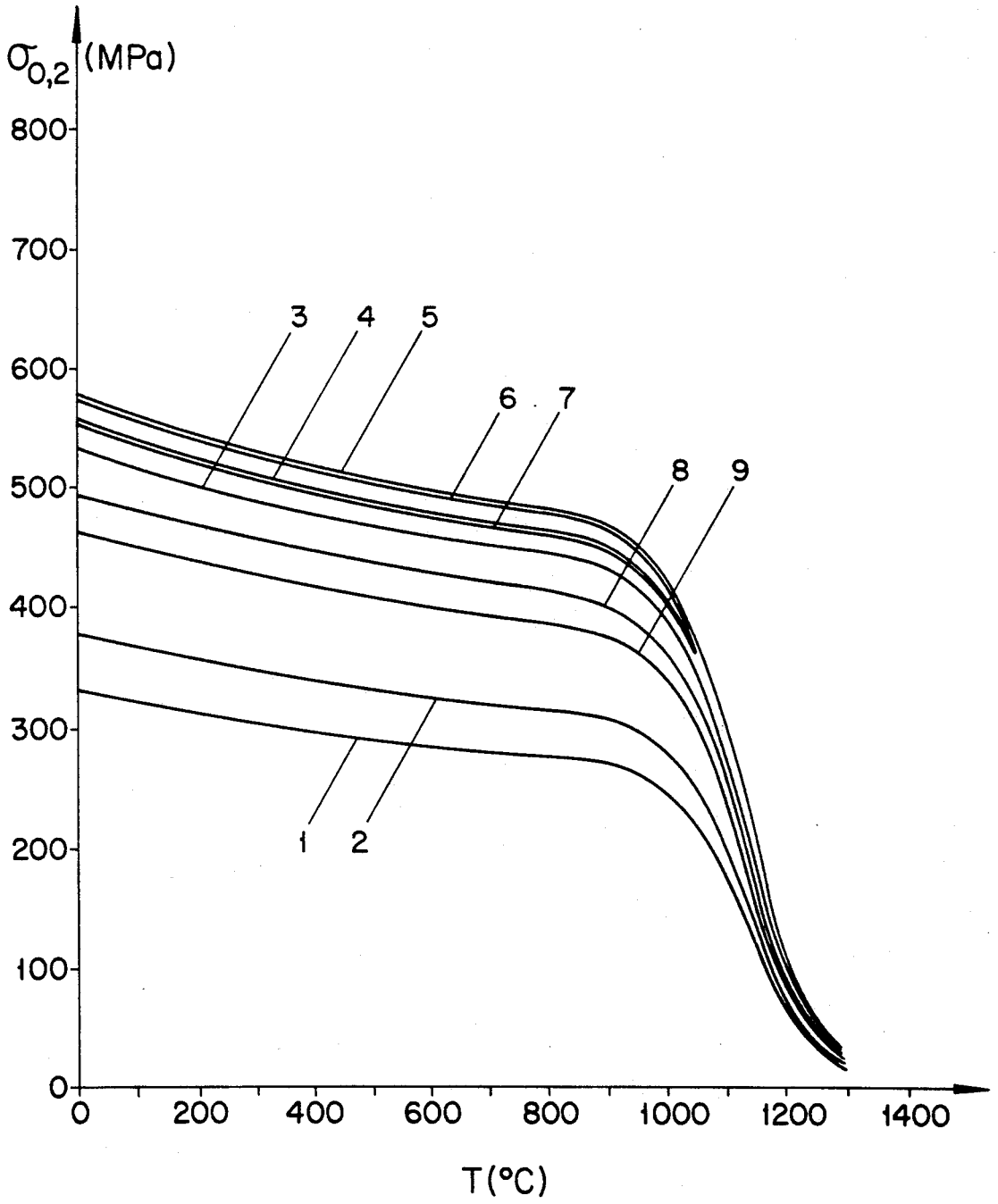
FIGS. 5–8 show graphs of the yield point $\sigma 0.2$ as a function of the temperature for the alloys 3–9, 14–20, 21–27 and 33–39 and also for the comparison alloys 1 and 2.

FIG. 5 is a graph of the yield point $\sigma$0.2 (MPa) as a function of the temperature T (° C.) for the alloys 1–9.

All of the curves show a similar behavior of the material. Up to a temperature of about 900° C. the yield point decreases, initially more sharply and then less sharply, to about 80% of the value at room temperature. From about 1,000° C. (above the elbow in the curve) the steep fall to low values then takes place.

Figure 6:
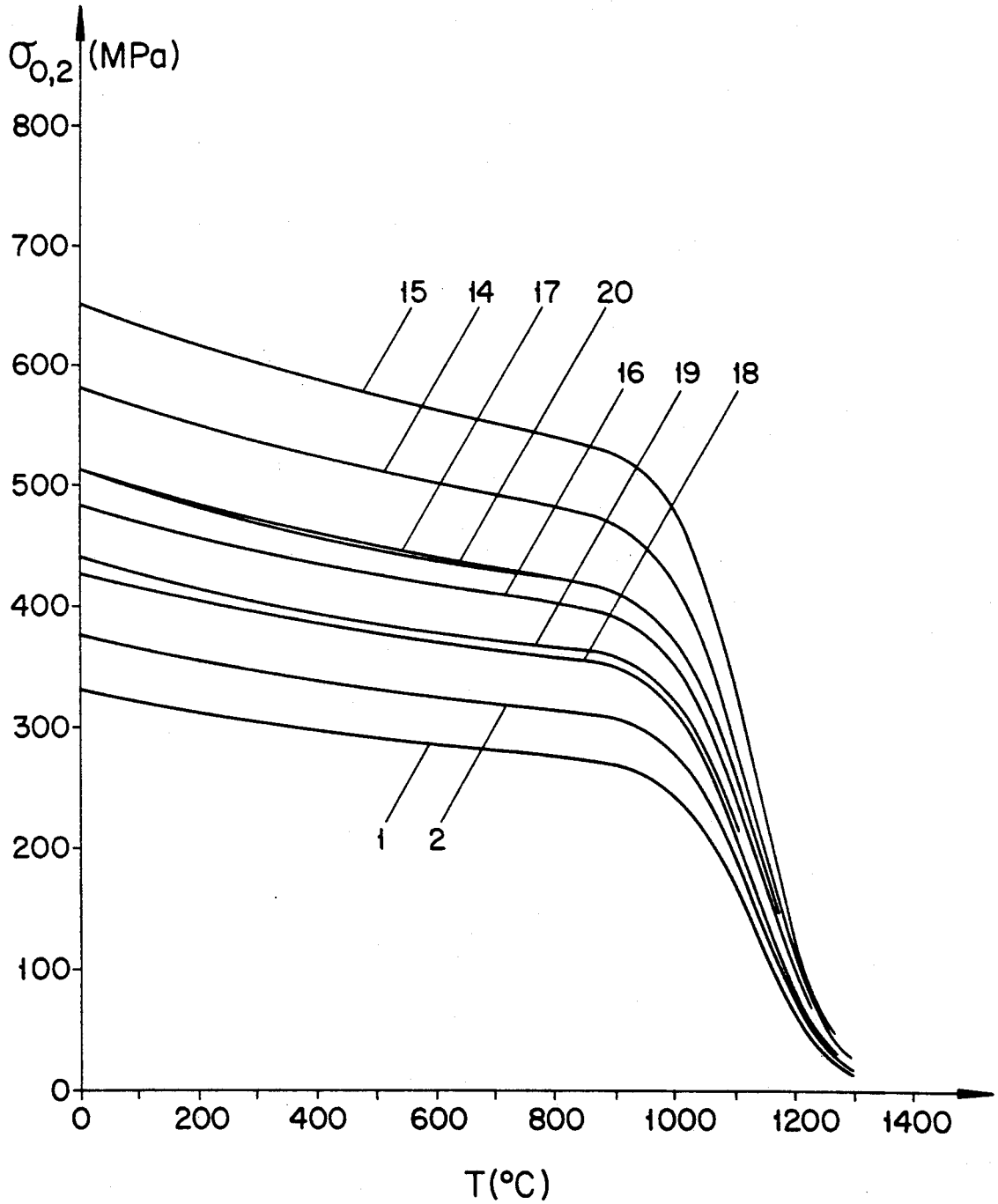

FIG. 6 is a graph of the yield point $\sigma$0.2 (MPa) as a function of the temperature T (° C.) for the alloys 14–20 and for the comparison alloys 1 and 2.

All of the curves show a similar behavior of the material. Up to a temperature of about 900° C. the yield point decreases, initially more sharply and then less sharply, to about 80% of the value at room temperature. From about 1,000° C. (above the elbow of the curve) the steep fall to low values then takes place.

Figure 7:
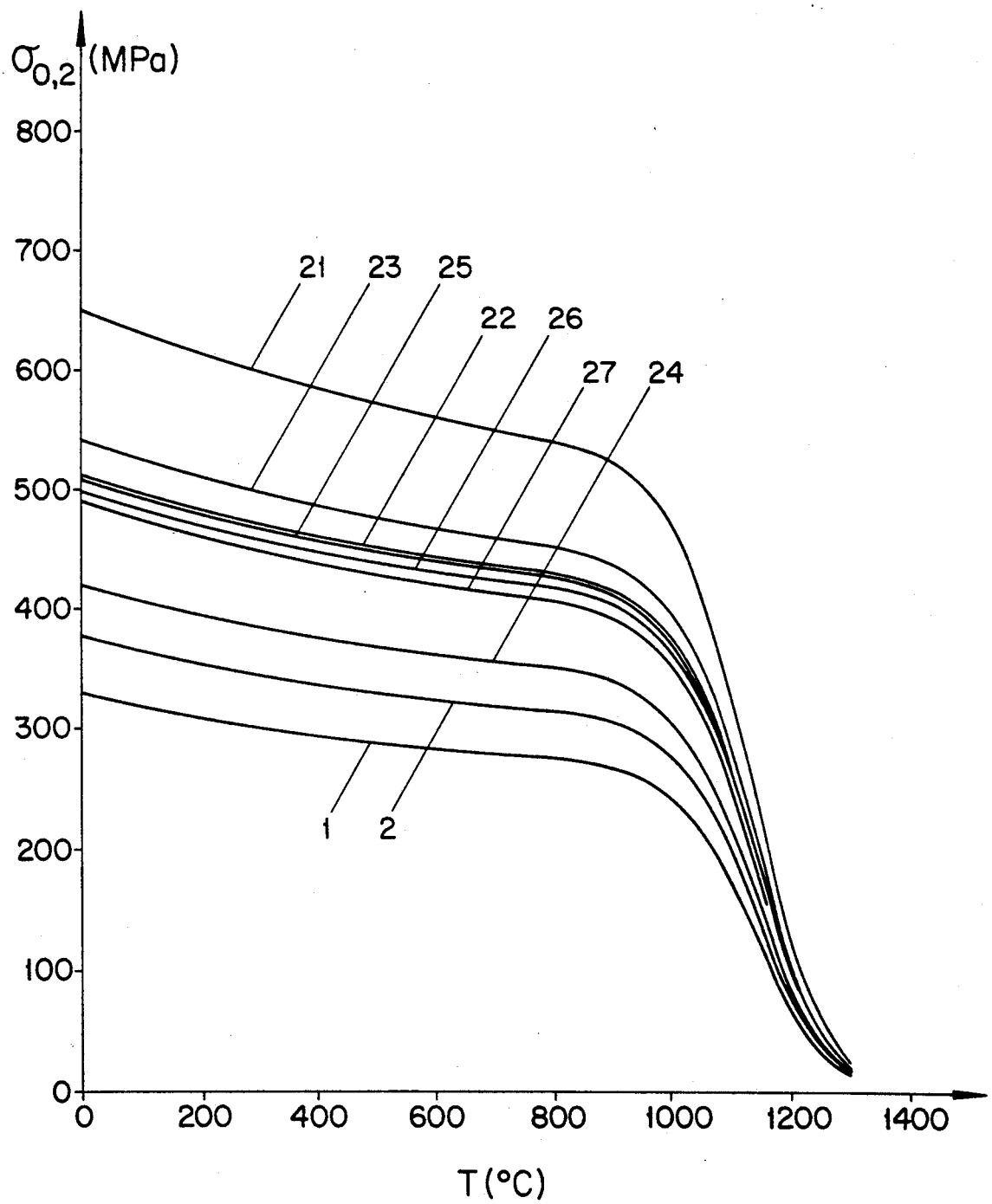

FIG. 7 is a graph of the yield point $\sigma$0.2 as a function of the temperature for the alloys 21–27 and for the comparison alloys 1 and 2.

What has been stated under FIG. 3 applies.

Figure 8:
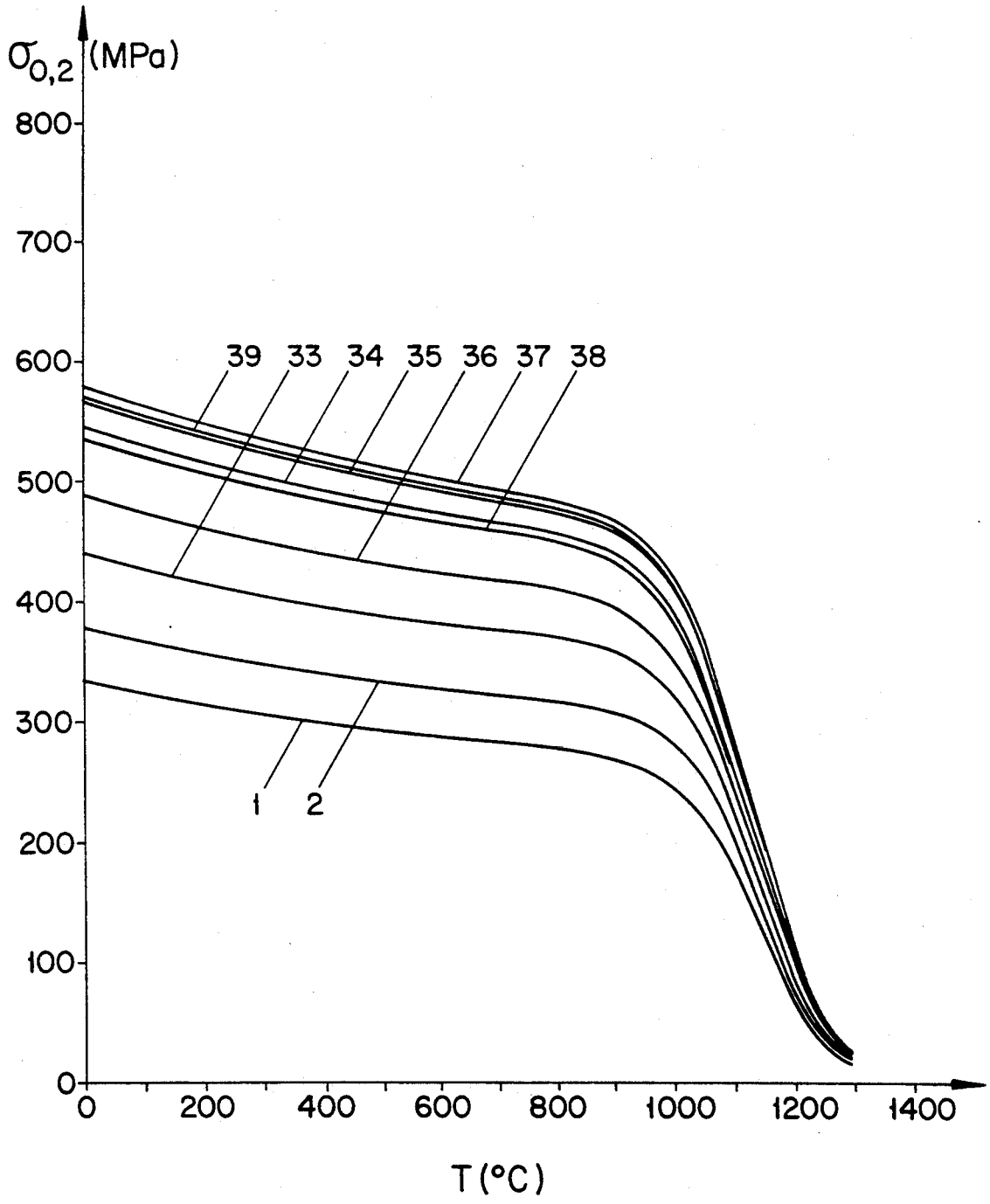

FIG. 8 is a graph of the yield point $\sigma$0.2 (MPa) as a function of the temperature T (° C.) for the alloys 33–39 and the comparison alloys 1 and 2.

All of the curves show a similar behavior of the material. Up to a temperature of about 900° C. the yield point decreases, initially more sharply and then less sharply, to about 80% of the value at room temperature. From about 1,000° C. (above the elbow of the curve), the steep fall to low values then takes place.

Figure 9:
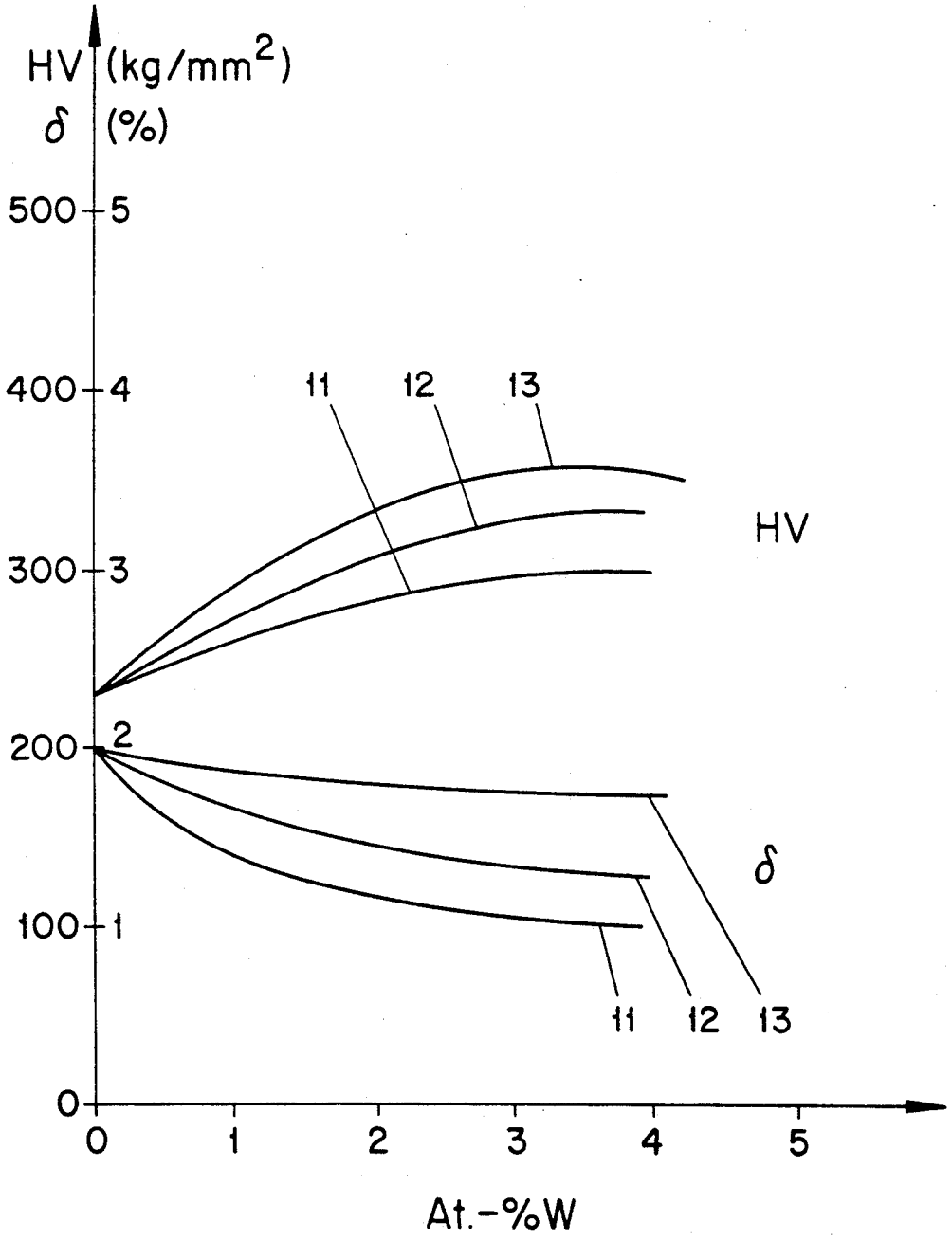
FIGS. 9–11 show graphs showing the influence of tungsten additions on the Vickers hardness HV and the elongation at break $\delta$ at room temperature for alloys 11–13, 28–32, 40 and 41 based on the intermetallic compound titanium aluminide.
Figure 10:
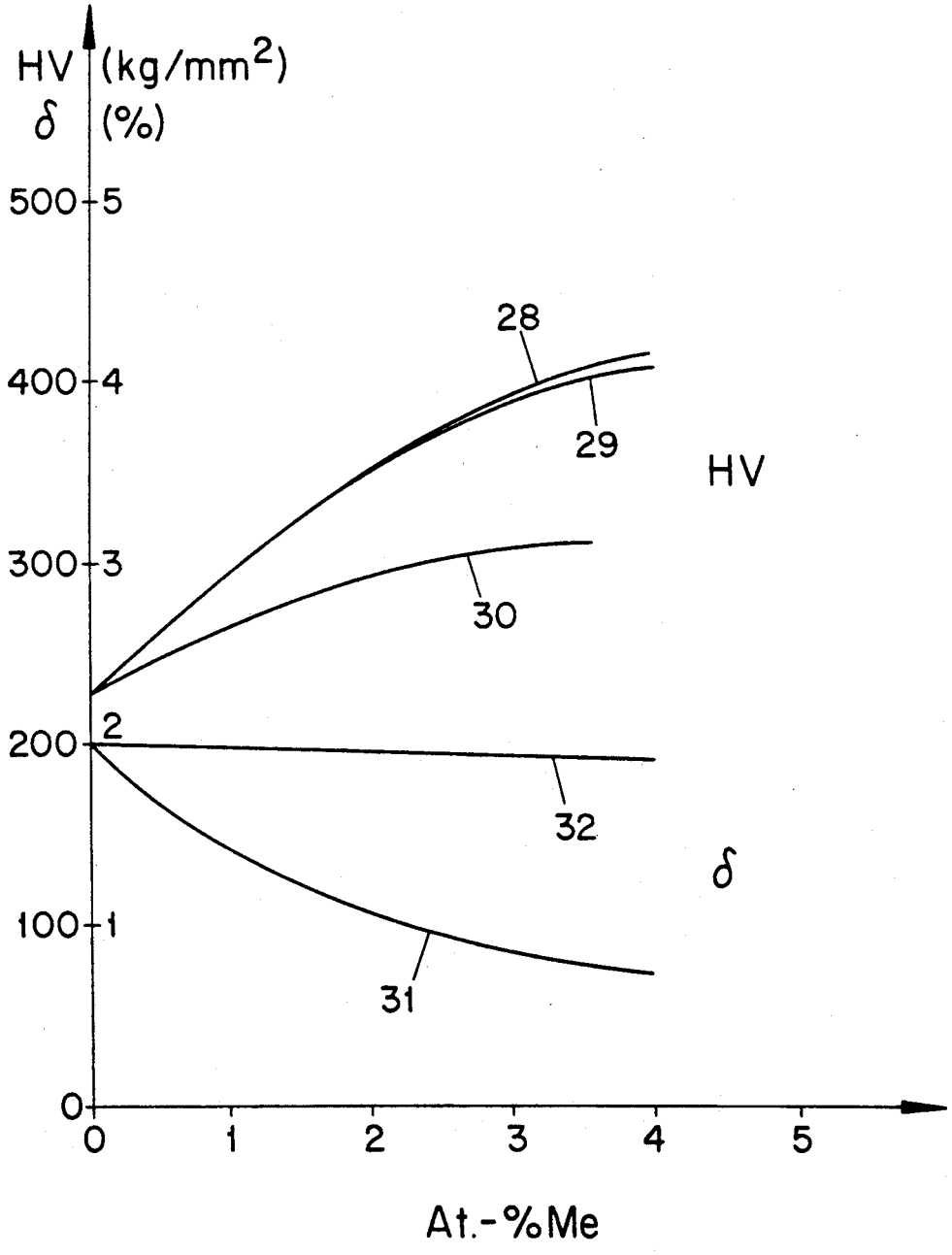
Figure 11:
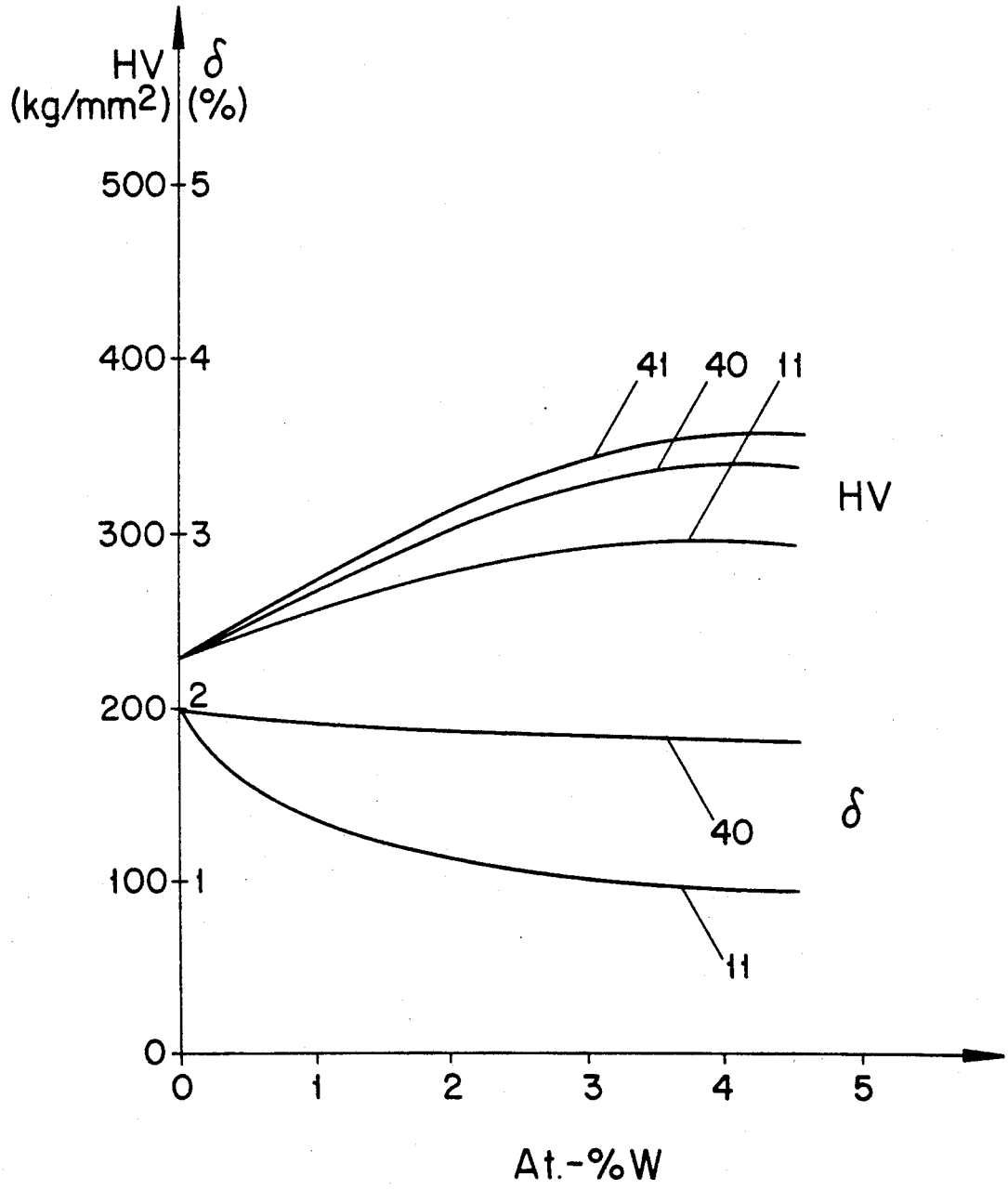

FIGS. 9, 10 and 11 relate in each case to graphs showing the influence of metal additives (Me, W) on the mechanical properties of alloys based on the intermetallic compound titanium aluminide at room temperature. In the case of alloys 11, 12, 13, 28, 29, 30, 40 and 41 the influence of tungsten or yttrium content on the Vickers hardness HV (kg/mm$^2$) is shown in each case and in the case of alloys 11, 12, 13, 31, 32 and 40 the influence of tungsten or yttrium content on the elongation at break $\delta$ (%), in each case at room temperature, is shown.

Alloy 11 serves as base. The compositions of the alloys are as follows:

| | Constituents in at. % | | | | | |
|---|---|---|---|---|---|---|
| Alloy | Al | Ge | Si | B | Me | Ti |
| 11 | 48 | — | — | — | W | remainder |
| 12 | 48 | 0.5 | — | — | W | remainder |
| 13 | 48 | — | 0.5 | — | W | remainder |
| 28 | 48 | — | — | — | Y | remainder |
| 29 | 48 | — | — | 0.5 | Y | remainder |
| 30 | 48 | 2 | — | — | Zr | remainder |
| 31 | 48 | — | — | — | Y | remainder |
| 32 | 48 | — | — | 0.5 | Y | remainder |
| 40 | 48 | — | — | 0.5 | W | remainder |
| 41 | 48 | — | — | 1 | W | remainder |

A considerable increase in hardness with a comparatively slight decrease in the elongation at break can be observed with increasing metal content Me (Me=W, Y or Zr). The ductility-promoting effect of the addition of boron is particularly noticeable.

Exemplary Embodiment 1

An alloy of the following composition:

Ti=51 at. %
Si=0.2 at. %
W=4 at. %
Al=44.8 at. % was melted under argon as a blanketing gas in an arc furnace.

The starting materials used were the individual elements having a degree of purity of 99.99%. The melt was cast to give a cast blank approximately 50 mm in diameter and approximately 70 mm high. The blank was melted again under blanketing gas and, likewise under blanketing gas, forced to solidify in the form of rods having a diameter of approximately 9 mm and a length of approximately 70 mm.

The rods were processed directly, without subsequent heat treatment, to give compression samples for short-time tests.

A further improvement in the mechanical properties by means of a suitable heat treatment is within the realms of possibility. Moreover, the possibility exists for improvement by ordered solidification, for which the alloy is particularly suitable.

Exemplary Embodiment 2

The following alloy was melted under argon by a procedure analogous to Example 1:

Ti=51 at. %
Si=0.5 at. %
Mo=3.5 at. %
Al=45 at. %

The melt was cast analogously to exemplary embodiment 1, melted again under argon and forced to solidify in rod form. The dimensions of the rods corresponded to exemplary embodiment 1. The rods were processed directly, without subsequent heat treatment, to give compression samples. The values thus achieved for the mechanical properties as a function of the test temperature approximately corresponded to those of Example 1. These values can be further improved by means of a heat treatment.

Exemplary Embodiment 3

The following alloy was melted under an argon atmosphere in exactly the same way as in Example 1:

Ti=50 at. %
Si=0.8 at. %
V=3 at. %
Al=46.2 at. %

The melt was cast analogously to Example 1, melted again under argon and cast to give prisms of square cross-section (7 mm×7 mm×80 mm). Specimens for compression, hardness and impact samples were produced from these prisms. The mechanical properties approximately corresponded to those of the preceding examples. A heat treatment gave a further improvement in these values.

Exemplary Embodiments 4–21

The following alloys were melted under argon:

Ti=50 at. %
Ge=1.4 at. %
Mn=1.6 at. %
Al=47 at. %
Ti=48 at. %
Ge=1 at. %
Mn=2 at. %
Al=49 at. %
Ti=51 at. %
Ge=0.6 at. %
Ta=3 at. %
Al=45.4 at. %
Ti=46 at. %
Ge=0.1 at. %
Hf=4 at. %
Al=49.9 at. %
Ti=51 at. %
Si=1.5 at. %
W=2 at. %
Mn=1.5 at. %
Al=44 at. %
Ti=50 at. %
Si=1 at. %
V=1.5 at. %
Cr=2.5 at. %
Al=45 at. %
Ti=48 at. %
Si=0.5 at. %
Ta=3 at. %
Nb=1 at. %
Al=47.5 at. %
Ti=46 at. %
Si=0.1 at. %
Mo=2.5 at. %
Hf=1.5 at. %
Al=49.9 at. %
Ti=51.5 at. %
Ge=0.2 at. %
W=1 at. %
V=3 at. %
Al=44.3 at. %
Ti=50 at. %
Ge=0.8 at. %
Mn=2.4 at. %
Cr=1.6 at. %
Al=45.2 at. %
Ti=47 at. %
Ge=1.3 at. %
Nb=2.5 at. %
Hf=0.5 at. %
Al=48.7 at. %
Ti=47 at. %
Si=0.3 at. %
W=1.5 at. %
Cr=1 at. %
Nb=1 at. %
Al=49.2 at. %
Ti=51 at. %
Si=0.7 at. %
Mo=0.7 at. %
Mn=3 at. %
V=0.3 at. %
Al=44.3 at. %
Ti=50 at. %
Si=1 at. %
V=1 at. %
Nb=1 at. %
Mn=1 at. %
Al=45 at. %
Ti=49 at. %

Si=1.2 at. %
Ta=1.5 at. %
W=1.4 at. %
Hf=1 at. %
Al=45.9 at. %
Ti=49 at. %
Ge=1.5 at. %
W=2.5 at. %
Mo=0.5 at. %
Cr=1 at. %
Al=45.5 at. %
Ti=51.5 at. %
Ge=1 at. %
V=1.5 at. %
Ta=0.5 at. %
Hf=1.5 at. %
Al=44 at. %
Ti=46 at. %
Ge=0.5 at. %
Nb=3 at. %
Mo=0.5 at. %
Cr=0.5 at. %
Al=49.5 at. %

In other respects the procedure was as under Example 1.

Exemplary Embodiment 22

Alloy 3 was melted under an argon atmosphere in exactly the same way as in Example 1:

Ti=48.5 at. %
Ge=0.5 at. %
W=3 at. %
Al=48 at. %

The melt was cast analogously to Example 1, melted again under argon and cast to give prisms of square cross-section (7 mm×7 mm×80 mm). Specimens for compression, hardness and impact samples were produced from these prisms. The change in the mechanical properties approximately corresponded to that in the preceding examples. The yield point $\sigma$0.2 at room temperature was 582 MPa. The change with the temperature T is indicated in FIG. 5. Alloy 1 (pure TiAl) has been plotted as reference quantity. The Vickers hardness HV at room temperature was on average 322 units. The change with the temperature T is plotted in FIG. 1. Alloy 1 (pure TiAl) is indicated as reference quantity. A heat treatment gave a further improvement in these values.

Exemplary Embodiment 23

Alloy 4 was melted from the pure elements, corresponding to Example 22:

Ti=50.5 at. %
Ge=0.5 at. %
W=3 at. %
Al=46 at. %

The yield point $\sigma$0.2 at room temperature was 553 MPa. The change with the temperature T is plotted in FIG. 5. The Vickers hardness HV at room temperature was on average 335 units. Its change with the temperature T is indicated in FIG. 1.

Exemplary Embodiment 24

Alloy 5 was melted from the pure elements in accordance with Example 22:

Ti=48.5 at. %
Si=0.5 at. %
W=3 at. %
Al=48 at. %

The yield point $\sigma$0.2 at room temperature was 578 MPa. The change in the yield point with the temperature T is plotted in FIG. 5. The Vickers hardness HV at room temperature reached a value of 350 units. Its change with the temperature T is recorded in FIG. 1. The hardness-increasing effect of the combined addition of W and Si compared with the pure TiAl can be observed. In the present case it is on average 75%.

Exemplary Embodiment 25

Alloy 6 was melted from pure elements in accordance with Example 22:

Ti=47.5 at. %
Si=0.5 at. %
W=4 at. %
Al=48 at. %

The yield point $\sigma$0.2 at room temperature was 572 MPa (FIG. 5). The Vickers hardness HV reached a value of 347 units at room temperature (FIG. 1).

Exemplary Embodiment 26

The procedure was precisely the same as in Example 22. The molten alloy 7 had the following composition:

Ti=48.5 at. %
Ge=0.5 at. %
Cr=3 at. %
Al=48 at %

The yield point $\sigma$0.2 at room temperature was 550 MPa (FIG. 5). The Vickers hardness HV at room temperature was on average 333 units (FIG. 1).

Exemplary Embodiment 27

The following alloy 8 was melted from the pure elements in accordance with Example 22:

Ti=48.5 at. %
Ge=0.5 at. %
Ta=3 at. %
Al=48 at. %

The yield point $\sigma$0.2 at room temperature reached a value of 495 MPa (FIG. 5). The Vickers hardness HV at room temperature was on average 300 units (FIG. 1).

Exemplary Embodiment 28

Alloy 9 of the following composition was melted from the pure elements in accordance with Example 22:

Ti=48.5 at. %
Si=0.5 at. %
Ta=3 at. %
Al=48 at. %

A yield point $\sigma$0.2 at room temperature of 461 MPa was reached (FIG. 5). The Vickers hardness HV at room temperature had a value of 279 units (FIG. 1).

Exemplary Embodiment 29

An alloy having the following composition:

Ti=48.5 at. %
Si=0.5 at. %
V=3 at. %
Al=48 at. % was melted in a furnace in accordance with Example 22.

The yield point $\sigma$0.2 at room temperature was 489 MPa. Its change with the temperature T is similar to that of alloy 8. The Vickers hardness HV at room temperature was 296 units. Its change with the temperature was similar to that of alloy 8.

Exemplary Embodiment 30

The following alloy was melted from the elements in a manner similar to Example 22:

Ti=47.5 at. %
Ge=0.5 at. %
Mn=2 at. %
Nb=2 at. %
Al=48 at. %

At room temperature the yield point $\sigma 0.2$ was approximately 478 MPa. The plot against the temperature is approximately midway between the corresponding plots for alloys 8 and 9. The Vickers hardness HV was 290 units at room temperature. Its plot against the temperature is approximately midway between the corresponding plots against the temperature for alloys 8 and 9.

Exemplary Embodiment 31

An alloy having the following composition was melted in accordance with Example 22:

Ti=48.5 at. %
Ge=0.5 at. %
Nb=3 at. %
Al=48 at. %

At room temperature the yield point $\sigma 0.2$ was 388 MPa. Its plot against the temperature T is virtually coincident with that for alloy 2. The Vickers hardness HV at room temperature reached 235 units. The corresponding plot against T is virtually coincident with that for alloy 2.

Exemplary Embodiment 32

An alloy having the following composition was melted from the pure elements in the furnace under blanketing gas:

Ti=49.5 at. %
Si=0.5 at. %
Mn=2 at. %
Al=48 at. %

The yield point $\sigma 0.2$ at room temperature was determined as 449 MPa. Its plot against the temperature T is just below that for alloy 9. The Vickers hardness HV at room temperature gave a value of 272 units. The plot against the temperature is just below that for alloy 9.

Exemplary Embodiment 33

The following alloy was melted under blanketing gas in accordance with Example 22:

Ti=44.5 at. %
Ge=0.5 at. %
W=3 at. %
Al=52 at. %

The yield point $\sigma 0.2$ at room temperature gave an average value of 522 MPa. Its plot against the temperature is just below that for alloy 3. The Vickers hardness HV at room temperature was found to be 316 units. The corresponding plot against the temperature T is just below that for alloy 3.

Exemplary Embodiment 34

An alloy having the following composition:

Ti=47 at. %
Y=3.5 at. %
Al=49.5 at. % was melted in an arc furnace under argon as blanketing gas. The starting materials used were the individual elements having a degree of purity of 99.99%. The melt was cast to give a cast blank approximately 60 mm in diameter and approximately 80 mm high. The blank was melted again under blanketing gas and, likewise under blanketing gas, forced to solidify in the form of rods having a diameter of about 8 mm and a length of about 80 mm.

The rods were processed directly, without subsequent heat treatment, to give compression samples for short-time tests. The mechanical properties thus achieved were determined as a function of the test temperature.

A further improvement in the mechanical properties by means of a suitable heat treatment is within the realms of possibility. Moreover, the possibility exists for improvement by ordered solidification, for which the alloy is particularly suitable.

Exemplary Embodiment 35

The following alloy was melted under argon in a manner analogous to Example 34:

Ti=52 at. %
Co=1 at. %
Al=47 at. %

The melt was cast in a manner analogous to exemplary embodiment 34, melted again under argon and forced to solidify in rod form. The dimensions of the rods corresponded to exemplary embodiment 34. The rods were processed directly, without subsequent heat treatment, to give compression samples. The values thus achieved for the mechanical properties as a function of the test temperature approximately corresponded to those of Example 34. These values can be further improved by means of a heat treatment.

Exemplary Embodiment 36

The following alloy was melted under an argon atmosphere in exactly the same way as in Example 34:

Ti=50 at. %
Zr=2.5 at. %
Al=47.5 at. %

The melt was cast in a manner analogous to Example 34, melted again under argon and cast to give prisms having a square cross-section (8 mm×8 mm×100 mm). Specimens for compression, hardness and impact samples were produced from these prisms. The mechanical properties approximately corresponded to those for the preceding examples. A heat treatment gave a further improvement in these values.

Exemplary Embodiments 37–46

The following alloys were melted under argon:

Ti=46 at. %
Ge=2 at. %
Al=52 at. %
Ti=48 at. %
Pd=0.5 at. %
Al=51.5 at. %
Ti=48 at. %
Zr=4 at. %
B=1.5 at. %
Al=46.5 at. %
Ti=47 at. %
Y=3 at. %
B=1 at. %
Al=49 at. %
Ti=48 at. %
Co=3 at. %
B=1 at. %

Al=48 at. %
Ti=50 at. %
Pd=0.2 at. %
B=0.8 at. %
Al=49 at. %
Ti=47.5 at. %
Y=1.5 at. %
Ge=0.5 at. %
Al=50.5 at. %
Ti=50 at. %
Co=2 at. %
Ge=2 at. %
Al=46 at. %
Ti=47 at. %
Zr=1 at. %
Ge=1.5 at. %
Al=50.5 at. %
Ti=52 at. %
Pd=0.3 at. %
Ge=0.5 1 at. %
Al=47.2 at. %

Samples were prepared for determination of the hardness, ductility and the yield point.

Exemplary Embodiment 47

Alloy 14 was melted in a small furnace under argon as blanketing gas, using the pure elements as the starting materials:

Ti=50 at. %
Y=2 at. %
Al=48 at. %

After remelting the blank, small samples were cast for determination of the hardness and of the yield point and also of the ductility. The rods had a diameter of 6 mm and were 60 mm long. The yield point $\sigma 0.2$ at room temperature was 582 MPa. The change with the temperature T is indicated according to curve 14 in FIG. 6. The change with temperature for alloy 1 (pure TiAl) is plotted as reference quantity. The Vickers hardness HV at room temperature was on average 352 units. The change with the temperature T is plotted in FIG. 2. Alloy 1 (pure TiAl) is again indicated as reference quantity.

Exemplary Embodiment 48

Alloy 15 was melted from the pure elements in a manner corresponding to Example 47:

Ti=49 at. %
Y=3 at. %
Al=48 at. %

The yield point $\sigma 0.2$ at room temperature was 650 Mpa (FIG. 6). The Vickers hardness HV at room temperature was on average 394 units (FIG. 2). The effect of the addition of Y in increasing the hardness, compared with the pure TiAl, is worthy of note and is virtually 100%.

Exemplary Embodiment 49

Alloy 16 was melted from the pure elements in accordance with Example 47:

Ti=49 at. %
Ge=3 at. %
Al=48 at. %

The yield point $\sigma 0.2$ at room temperature was 482 MPa (FIG. 6). The Vickers hardness HV at room temperature reached a value of 292 units (FIG. 2).

Exemplary Embodiment 50

Alloy 17 was melted from the pure elements in accordance with Example 47:

Ti=49 at. %
Pd=3 at. %
Al=48 at. %

The yield point $\sigma 0.2$ at room temperature was 512 MPa (FIG. 6). The Vickers hardness HV reached a value of 310 units at room temperature (FIG. 2).

Exemplary Embodiment 51

The procedure was exactly the same as in Example 47. The molten alloy 18 had the following composition:

Ti=50 at. %
Co=2 at. %
Al=48 at. %

The yield point $\sigma 0.2$ at room temperature was 426 MPa (FIG. 6). The Vickers hardness HV at room temperature was on average 258 units (FIG. 2).

Exemplary Embodiment 52

Alloy 19 of the following composition:

Ti=51 at. %
Zr=1 at. %
Al=48 at. % was melted in accordance with Example 17.

The yield point 94 0.2 at room temperature was 439 MPa (FIG. 6). The Vickers hardness HV at room temperature reached on average 266 units (FIG. 2).

Exemplary Embodiment 53

The following alloy 20:

Ti=49 at. %
Zr=3 at. %
Al=48 at. % was melted from the pure elements in accordance with Example 47.

The yield point $\sigma 0.2$ at room temperature reached a value of 512 MPa (FIG. 6) The Vickers hardness HV at room temperature was on average 310 units (FIG. 2). The effect of the addition of Zr in increasing the hardness, compared with alloy 1 (pure TiAl), is thus about 55%.

Exemplary Embodiment 54

Alloy 21 of the following composition:

Ti=48 at. %
B=0.5 at. %
Y=3 at. %
Al=48 at. % was melted from the pure elements in accordance with Example 47.

A yield point $\sigma 0.2$ at room temperature of 645 MPa was achieved (FIG. 7). The Vickers hardness HV at room temperature had a value of 390 units (FIG. 3).

Exemplary Embodiment 55

Alloy 22 of the following composition:

Ti=47 at. %
Ge=2 at. %
Zr=3 at. %
Al=48 at. % was melted in a furnace in accordance with Example 47.

The yield point $\sigma 0.2$ at room temperature was 513 MPa (FIG. 7). The Vickers hardness HV at room temperature was 311 units (FIG. 3).

Exemplary Embodiment 56

Alloy 23 was melted from the elements in a manner similar to Example 47:

Ti=48.5 at. %
Ge=0.5 at. %
Y=3 at. %
Al=48 at. %

At room temperature the yield point $\sigma 0.2$ was approximately 539 Mpa (FIG. 7). The Vickers hardness HV was 326 units at room temperature (FIG. 3).

Exemplary Embodiment 57

Alloy 24 of the following composition:

Ti=50.5 at. %
Ge=0.5 at. %
Zr=1 at. %
Al=48 at. % was melted from the elements in accordance with Example 47.

The yield point $\sigma 0.2$ at room temperature reached a value of 416 MPa (FIG. 7). The Vickers hardness HV at room temperature corresponded to 252 units (FIG. 3).

Exemplary Embodiment 58

Alloy 25 of the following composition:

Ti=48.5 at. %
Ge=0.5 at. %
Zr=3 at. %
Al=48 at. % was melted in accordance with Example 47.

At room temperature the yield point $\sigma 0.2$ was 509 MPa (FIG. 7). The Vickers hardness HV at room temperature reached 308 units (FIG. 3).

Exemplary Embodiment 59

Alloy 26 of the following composition:

Ti=48.5 at. %
Ge=0.5 at. %
Pd=3 at. %
Al=48 at. % was melted from the pure elements in the furnace under blanketing gas.

The yield point $\sigma 0.2$ at room temperature was determined as 498 MPa (FIG. 7). The Vickers hardness HV at room temperature gave a value of 302 units (FIG. 3).

Exemplary Embodiment 60

The following alloy 27 was melted under blanketing gas in accordance with Example 47:

Ti=48.5 at. %
Ge=0.5 at. %
Co=3 at. %
Al=48 at. %

The yield point $\sigma 0.2$ at room temperature gave an average value of 488 MPa (FIG. 7). The Vickers hardness HV at room temperature was found to be 296 units (FIG. 3).

Effect of the Elements in Exemplary Embodiments 34–60

An increase in hardness and in strength was achieved in all cases by alloying the elements Y, Zr, Pd, Ge or Co to a Ti/Al base alloy. The effect is in decreasing order: Y has the strongest effect and Co the weakest effect.

In general, the increase in hardness is associated with a more or less substantial loss in ductility, which, however, can at least partially be made good again by alloying further elements which have the effect of increasing the toughness.

An addition of less than 0.5 at. % of an element usually has hardly any effect. On the other hand, a certain saturation phenomenon is shown at about 3–4 at. %, so that further additions are pointless or cause the properties of the material as a whole to deteriorate again.

B in general has a powerful toughness-increasing effect in combination with other elements which increase the strength. See FIG. 10. Here the loss in ductility caused by alloying of Y could virtually be made good by an addition of only 0.5 at. % of B. Additions of more than 1 at. % of B are not necessary. In some cases Ge has an effect which is similar to that of B but considerably weaker. Additions of more than 2 at. % of Ge in the presence of further elements have little point.

For further optimization of the properties, polynary systems are available, with which an attempt is made to make good again the negative properties of individual additions by simultaneous alloying of other elements.

The field of application of the modified titanium aluminides advantageously extends to temperatures between 600° C. and 1,000° C.

Exemplary Embodiment 61

Alloy 33 of the following composition:

Ti=50.5 at. %
W=1 at. %
B=0.5 at. %
Al=48 at. % was melted in an arc furnace under argon as blanketing gas.

The starting materials used were the individual elements having a degree of purity of 99.99%. The melt was cast to give a cast blank approximately 60 mm in diameter and approximately 80 mm high. The blank was melted again under blanketing gas and, likewise under blanketing gas, forced to solidify in the form of rods having a diameter of about 12 mm and a length of about 80 mm.

The rods were processed directly, without subsequent heat treatment, to give compression samples for short-time tests.

A further improvement in the mechanical properties by means of a suitable heat treatment is within the realms of possibility. Moreover, the possibility exists for improvement by ordered solidification, for which the alloy is particularly suitable.

The Vickers hardness HV (kg/mm$^2$) at room temperature gave a value of 266 units (FIG. 4). The alloys 1 (pure TiAl) and also alloy 2 (48 at. % Al, remainder Ti) have been plotted as reference quantities for this. The yield point $\sigma 0.2$ (MPa) at room temperature had a value of 440 MPa (FIG. 8). Alloys 1 (pure TiAl) and also alloy 2 (48 at. % Al and 52 at. % Ti) are again indicated as reference quantities for this (FIG. 8).

Exemplary Embodiment 62

The following alloy 34 was melted under argon in a manner analogous to Example 61:

Ti=48.5 at. %
W=3 at. %
B=0.5 at. %
Al=48 at. %

The melt was cast in a manner analogous to exemplary embodiment 61, melted again under argon and forced to solidify in rod form. The dimensions of the rods corresponded to exemplary embodiment 61. The rods were processed directly, without subsequent heat treatment, to give compression samples. The values thus achieved for the mechanical properties as a function of the test temperature are shown in FIGS. 4 and 8. These values can be further improved by means of a heat treatment. The Vickers hardness HV at room temperature was 329 units. The yield point $\sigma 0.2$ at room temperature reached a value of 543 MPa. The effect of the addition of W in increasing the strength and the hardness can clearly be seen.

Exemplary Embodiment 63

The following alloy 35 was melted under an argon atmosphere in exactly the same way as in Example 61:

Ti=48 at. %
W=3 at. %
B=1 at. %
Al=48 at. %

The Vickers hardness at room temperature was 342 units (FIG. 4). The yield point $\sigma 0.2$ at room temperature had a value of 565 MPa (FIG. 8). The mechanical properties are thus hardly changed any further by the further addition of boron in an amount of up to 1 at. %. Therefore, this value is also the justifiable upper limit for the boron content in the alloy.

Exemplary Embodiment 64

The following alloy 36 was melted from the pure elements in accordance with Example 61:

Ti=49.5 at. %
Mn=2 at. %
B=0.5 at. %
Al=48 at. %

At room temperature the Vickers hardness was 295 units (FIG. 4). The yield point $\sigma 0.2$ at room temperature had a value of 487 MPa (FIG. 8). The effect of manganese in increasing the hardness is accordingly somewhat poorer than that of tungsten for a given boron content.

Exemplary Embodiment 65

The following alloy 37 was melted in accordance with Example 61:

Ti=48.5 at. %
Cr=3 at. %
B=0.5 at. %
Al=48 at. %

The Vickers hardness at room temperature reached a value of 350 units (FIG. 4). At room temperature the yield point $\sigma 0.2$ was 578 MPa (FIG. 8). The highest increase in strength of the series of doped TiAl investigated here is apparently achieved by the combined addition of tungsten and boron.

Exemplary Embodiment 66

The following alloy 38 was melted from the pure elements under a blanketing gas atmosphere by a method corresponding to Example 61:

Ti=47.5 at. %
Mn=2 at. %
Nb=2 at. %
B=0.5 at. %
Al=48 at. %

At room temperature the Vickers hardness was 323 units (FIG. 4). The yield point $\sigma 0.2$ was 533 MPa at room temperature (FIG. 8). The combined action of manganese and boron with the simultaneous presence of 2 at. % of niobium approximately corresponds to that of chromium with boron.

Exemplary Embodiment 67

Alloy 39 of the following composition:

Ti=48.5 at. %
Cr=2 at. %
Mn=1 at. %
B=0.5 at. %
Al=48 at. % was melted in accordance with Example 61.

The test gave a Vickers hardness at room temperature of 345 units (FIG. 4). At room temperature a yield point $\sigma 0.2$ of 569 MPa was measured (FIG. 8).

The influence of W and B on the mechanical properties is summarized again in FIG. 11. Curves of similar shape result for the other doping elements. Usually the hardness passes through a maximum at about 3 to 4 at. % of doping element. Additions substantially higher than 4 at. % therefore have little point. This applies at least strictly speaking for the individual elements.

Exemplary Embodiments 68–77

The following alloys were melted under an argon atmosphere using a procedure corresponding to Example 61:

Ti=48.5 at. %
Nb=3 at. %
B=0.5 at. %
Al=48 at. %
Ti=46.5 at. %
W=3 at. %
Cr=2 at. %
B=0.5 at. %
Al=48 at. %
Ti=46 at. %
W=1 at. %
Cr=2 at. %
Nb=2 at. %
B=1 at. %
Al=48 at. %
Ti=46.5 at. %
W=2 at. %
Mn=1 at. %
Nb=2 at. %
B=0.5 at. %
Al=48 at. %
Ti=46 at. %
W=1 at. %
Cr=1 at. %
Mn=2 at. %
Nb=1 at. %
B=1 at. %
Al=48 at. %
Ti=47 at. %
W=3 at. %
Mn=3 at. %
B=1 at. %
Al=46 at. %
Ti=47 at. %
W=4 at. %
Nb=1 at. %
B=0.5 at. %
Al=47.5 at. %
Ti=46.5 at. %
Cr=2 at. %
Nb=1 at. %
B=0.5 at. %

Al=50 at. %
Ti=46.2 at. %
W=1 at. %
Cr=1 at. %
Mn=0.7 at. %
B=0.1 at. %
Al=51 at. %
Ti=46 at. %
Cr=0.7 at. %
Mn=0.6 at. %
Nb=0.5 at. %
B=0.2 at. %
Al=52 at. %

In other respects the procedure was as under Example 61.

Action of the Elements in Exemplary Embodiments 61–77

An increase in hardness and in strength is achieved in all cases by alloying the elements W, Cr, Mn and Nb, individually or in combination, with a Ti/Al base alloy. The effect of combinations (for example Mn+Nb) is the most pronounced. In general, the increase in hardness is associated with a more or less substantial loss in ductility, which, however, can at least partially be made good again by alloying further elements which have the effect of increasing the toughness.

An addition of less than 0.5 at. % of an element usually has hardly any effect. On the other hand, a certain saturation phenomenon is shown at about 3–4 at. %, so that further additions are pointless or cause the properties of the material as a whole to deteriorate again.

B in general has a pronounced toughness-increasing effect in combination with other elements which increase the strength (FIG. 11). Here the loss in ductility caused by alloying W could be virtually made good by an addition of only 0.5 at. % of B. Additions of more than 1 at. % of B are not necessary.

For further optimization of the properties, polynary systems are available, with which it is attempted to make good again the negative properties of individual additions by simultaneous alloying of other elements.

The field of application of the modified titanium aluminides advantageously extends to temperatures between 600° C. and 1,000° C.

The high-temperature alloy according to the invention for components subjected to high mechanical stress in thermal equipment is not restricted to the exemplary embodiments and can have the following composition:

$$Ti_xEl_yMe_zAl_{l-(x+y+z)},$$

in which

El=B, Ge or Si and Me=Co, Cr, Ge, Hf, Mn, Mo, Nb, Pd, Ta, V, W, Y, and/or Zr and:

| | | | |
|---|---|---|---|
| 0.46 | ≦x | ≦0.54, | |
| 0.001 | ≦y | ≦0.015 | for El = Ge and Me = Cr, Hf, Mn, Mo, Nb, Ta, V and/or W, |
| 0.001 | ≦y | ≦0.015 | for El = Si and Me = Hf, Mn, Mo, Ta, V and/or W, |
| 0 | ≦y | ≦0.01 | for El = B and Me = Co, Ge, Pd, Y and/or Zr, |
| 0 | ≦y | ≦0.02 | for El = Ge and Me = Co, Ge, Pd, Y and/or Zr, |
| 0.0001 | ≦y | ≦0.01 | for El = B and Me = Cr, Mn, Nb and/or W, |
| 0.01 | ≦z | ≦0.04 | if Me = an individual element, |
| 0.01 | ≦z | ≦0.08 | if Me = two or more individual elements and |
| 0.46 | ≦(x + y + z) | ≦0.54. | |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high temperature alloy for a component subjected to high mechanical stress in thermal equipment, based on doped TiAl, having the composition $Ti_xEl_yMe_zAl_{1-(x+y+z)}$, in which El=Si and Me=Hf, Mo, Ta and/or W and

| | | | |
|---|---|---|---|
| 0.46 | ≦ x ≦ | 0.54 | |
| 0.001 | ≦ y ≦ | 0.015 | |
| 0.01 | ≦ z ≦ | 0.04 | if Me is an individual element, |
| 0.01 | ≦ z ≦ | 0.08 | if Me are two or more individual elements, |
| 0.46 | ≦ (x + y + z) ≦ | 0.54. | |

2. The alloy of claim 1, wherein Me comprises Ta or W.

3. The alloy of claim 1, wherein Me comprises Hf and at least one of Mo, ta and W.

* * * * *